US007051525B2

(12) United States Patent
Keskiniva et al.

(10) Patent No.: US 7,051,525 B2
(45) Date of Patent: May 30, 2006

(54) METHOD AND APPARATUS FOR MONITORING OPERATION OF PERCUSSION DEVICE

(75) Inventors: Markku Keskiniva, Tampere (FI); Timo Kemppainen, Tampere (FI); Vesa Uitto, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 107 days.

(21) Appl. No.: 10/492,615

(22) PCT Filed: Oct. 17, 2002

(86) PCT No.: PCT/FI02/00808

§ 371 (c)(1),
(2), (4) Date: Apr. 15, 2004

(87) PCT Pub. No.: WO03/033216

PCT Pub. Date: Apr. 24, 2003

(65) Prior Publication Data

US 2004/0244493 A1 Dec. 9, 2004

(30) Foreign Application Priority Data

Oct. 18, 2001 (FI) ..... 20012021

(51) Int. Cl.
*F16D 31/02* (2006.01)

(52) U.S. Cl. ..... 60/446; 60/452

(58) Field of Classification Search ..... 60/446, 60/452

See application file for complete search history.

(56) References Cited

U.S. PATENT DOCUMENTS

| | | | | |
|---|---|---|---|---|
| 4,699,223 | A | 10/1987 | Norén | |
| 4,800,797 | A | 1/1989 | Comarmond | |
| 5,481,875 | A * | 1/1996 | Takamura et al. | 60/452 |
| 6,112,832 | A | 9/2000 | Muuttonen et al. | |
| 6,202,411 | B1 * | 3/2001 | Yamashita | 60/452 |
| 6,510,902 | B1 | 1/2003 | Prokop et al. | |

FOREIGN PATENT DOCUMENTS

| | | | |
|---|---|---|---|
| EP | 0 112 810 | A2 | 7/1984 |
| EP | 0112810 | A2 | 7/1984 |
| EP | 0 825 330 | A1 | 2/1998 |
| EP | 0825330 | A1 | 2/1998 |
| EP | 1 055 489 | A2 | 11/2000 |
| JP | 07-174647 | A | 7/1995 |
| JP | 09-287379 | A | 11/1997 |
| JP | 11-333757 | A | 12/1999 |
| JP | 11333757 | A | 12/1999 |

* cited by examiner

*Primary Examiner*—Edward K. Look
*Assistant Examiner*—Igor Kershteyn
(74) *Attorney, Agent, or Firm*—Drinker Biddle & Reath LLP

(57) ABSTRACT

A method and an apparatus for monitoring the operation of a percussion device, which percussion device comprises a percussion piston and a pressure channel for supplying pressure medium to the percussion device for moving the percussion piston. The method and the apparatus measure pressure pulsation of the pressure medium acting in the pressure channel, which pressure pulsation is depicted as a pressure curve. From pressure pulsation are determined parameters depicting the operating state of the percussion device and the operating state of the percussion device is determined on the basis of the parameters. In addition, an arrangement for controlling the operation of the percussion device on the basis of the operating state of the percussion device.

9 Claims, 4 Drawing Sheets

METHOD AND APPARATUS FOR MONITORING OPERATION OF PERCUSSION DEVICE

TITLE OF THE INVENTION

1. Field of the Invention

The invention relates to a method for monitoring the operation of a percussion device, which percussion device comprises a percussion piston and a pressure channel for supplying pressure medium to the percussion device for moving the percussion piston, and which method measures pressure pulsation of the pressure medium acting in the pressure channel, which pressure pulsation is depicted as a pressure curve.

The invention also relates to an apparatus for monitoring the operation of a percussion device, which percussion device comprises a percussion piston and a pressure channel for supplying pressure medium to the percussion device for moving the percussion piston, and which apparatus comprises a sensor, arranged in connection with the pressure channel, measuring pressure pulsation of the pressure medium acting in the pressure channel and depicting said pressure pulsation as a pressure curve.

The invention further relates to an arrangement for adjusting the operation of a percussion device, which percussion device comprises a percussion piston and a pressure channel for supplying pressure medium to the percussion device for moving the percussion piston, and which arrangement comprises a sensor, arranged in connection with the pressure channel, measuring pressure pulsation of the pressure medium acting in the pressure channel and depicting said pressure as a pressure curve.

2. Background of the Invention

When holes are drilled in a rock with a rock drill machine, the drilling conditions vary in different ways. Layers in the rock mass may vary in hardness, and therefore characteristics affecting the drilling should be adjusted according to drilling resistance. In the drilling, there are simultaneously four different functions in use: rotating the drill in a hole to be drilled, breaking the rock by hitting a drill shank with the percussion piston as well as drill feed and flushing, by which drilling waste is removed from the drilled hole. When rock is broken by striking the drill shank with the percussion piston, impact energy of the percussion piston is transmitted by means of drill rods, which conventionally serve as extensions of the drill shank, to a drill bit which strikes on the rock making it break. The correct operation of the percussion device thus contributes considerably to the good drilling result. Percussion hammers, in which a tool driven by the percussion device is arranged to break the surface to be broken, do not employ tool rotation nor flushing. It is mainly the operation of the percussion device that affects the breakage result, if the effect of the tool characteristics is not taken into account. Essential variables for breaking the rock include length of an impact pulse, amplitude of the impact pulse, impact frequency and a suitable bit/rock contact. In practice, of these variables all others but the length of the impact pulse are adjustable ones.

However, it is very difficult to control the operation of the percussion device such that the best possible drilling or breakage result is achieved, because there has been no reliable solution for monitoring the operation of the percussion device. It is difficult to monitor the operation of the percussion device while the drill or the percussion hammer is running. Attempts have been made to measure the position of the percussion piston with laser-operated or inductive sensoring solutions arranged in the percussion device. U.S. Pat. No. 4,699,223 discloses use of an inductive sensor for measuring the position of a percussion piston. A problem with solutions based on sensors arranged in a percussion device is poor durability of sensors in the demanding conditions, in which the drills and the percussion hammers are used.

BRIEF SUMMARY OF THE INVENTION

An object of the present invention is to provide a novel solution for monitoring the operation of a percussion device.

The method of the invention is characterized by determining, from pressure pulsation, parameters depicting the operating state of a percussion device and determining the operating state of the percussion device on the basis of said parameters.

Further, the apparatus of the invention is characterized in that the apparatus further comprises an analyzing device which is arranged to determine parameters depicting the operating state of the percussion device from pressure pulsation and to determine the operating state of the percussion device on the basis of said parameters.

Further, the arrangement of the invention is characterized in that the arrangement comprises an analyzing device that is arranged to determine parameters depicting the operating state of the percussion device from pressure pulsation and to determine the operating state of the percussion device on the basis of said parameters and that the arrangement comprises a control unit that is arranged to control the operation of the percussion device on the basis of the operating state of the percussion device.

The basic idea of the invention is that for monitoring the operation of the percussion device, which comprises a percussion piston and a pressure channel for supplying pressure medium to the percussion device for moving the percussion piston, pressure pulsation of the pressure medium acting in the pressure channel is measured, which pressure pulsation is depicted as a pressure curve, and parameters depicting the operating state of the percussion device are determined from the pressure curve, and the operating state of the percussion device is determined on the basis of said parameters. In the present document the pressure curve refers to pressure pulsation that is measured at a sampling frequency that is substantially higher than the running frequency of the percussion device, whereby very fast pressure variations can be registered. Pressure pulsation is mainly generated by a reciprocating movement of the percussion piston, an impact of the percussion piston, a rebound of the percussion piston and hydraulic control provided by a control valve of the percussion device. According to a first embodiment of the invention the operating state of the percussion device is depicted on the basis of at least one of the following parameters: a position of the percussion piston in the percussion device, a piston stroke of the percussion piston, impact velocity of the percussion piston and rebound velocity of the percussion piston. According to a second embodiment of the invention the operating state of the percussion device is controlled on the basis of the parameters depicting the operating state of the percussion device. According to a third embodiment of the invention the percussion device is arranged for use in a rock drill machine and an operating state of the percussion device is determined on the basis of the parameters depicting the operating state of the rock drill machine.

The invention has an advantage that the operation of the percussion device can be monitored accurately and in real time, which further enables the adjustment of the operation of the percussion device on the basis of information obtained on one or more previous impacts. The pressure curve of the percussion device can be measured in a simple manner and the measurement can be carried out in the vicinity of the percussion device, or elsewhere, on a boom or base carrying the percussion device, whereby it will not be necessary to arrange any fault-prone sensors in the percussion device. Further, the pressure curve measurement and interpretation make it possible to monitor the trend of the percussion device state and to use it for monitoring the condition of the percussion device.

BRIEF DESCRIPTION OF THE DRAWING FIGURES

In the following the invention will be described in greater detail in connection with the attached drawings, wherein FIG. 1 is a schematic side view of a percussion device, partly cut open, to which the solution of the invention is applied;

DETAILED DESCRIPTION OF THE PREFERRED EMBODIMENT(S)

Figure 1:
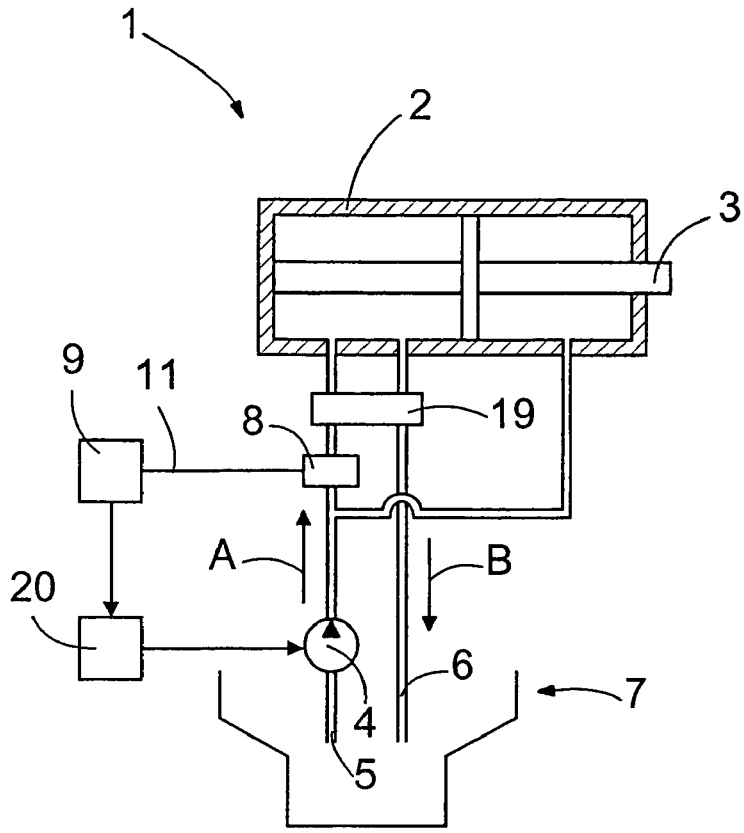

FIG. 1 is a schematic side view of a percussion device 1, partly cut open. The percussion device 1 comprises a frame 2 and a percussion piston 3. The percussion device 1 can be one employed in a drill or a percussion hammer. The percussion device 1 is hydraulically operated, and hydraulic oil, bio-oil or water can be used as hydraulic or pressure fluid. FIG. 1 further shows a pump 4 needed for driving the percussion device 1, which pump 4 pumps pressure fluid through a pressure channel 5, in the direction of arrow A, to the percussion device 1 in order to move the percussion piston 3 to the right in FIG. 1, i.e. to perform a stroke. During a reverse stroke of the percussion piston 3 the pressure fluid returns to a tank 7 through a return channel 6 in the direction of arrow B. FIG. 1 also shows a control valve 19 used for controlling the operation of the percussion device 1. The general structure and operating principle of the percussion device in the rock drill machine or the percussion hammer are known per se to a person skilled in the art, so they need not be described in greater detail herein, and for the sake of clarity the structure of the percussion device 1 is only shown schematically in FIG. 1.

Figure 2:
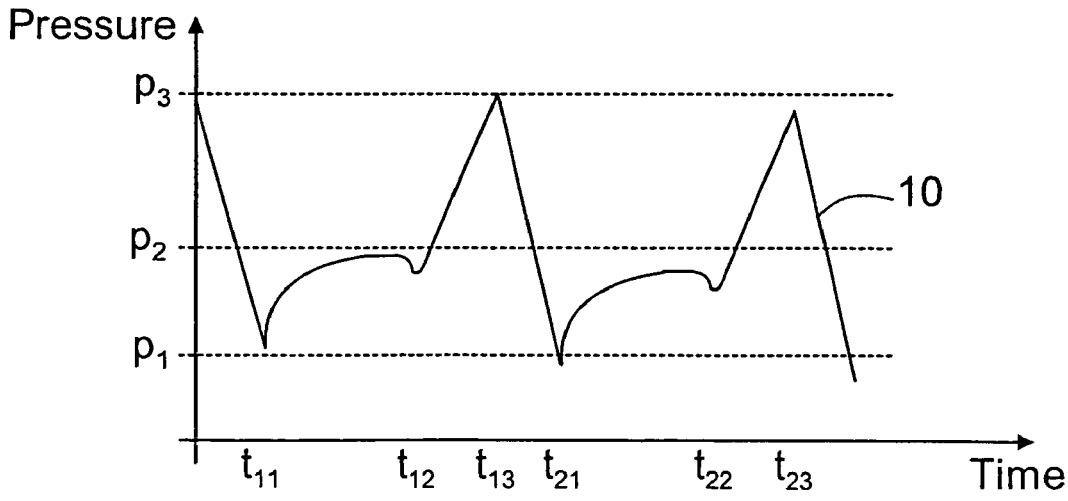
FIG. 2 is a schematic view of a pressure curve of pressure medium acting in a pressure channel.

FIG. 1 further shows schematically a pressure sensor 8, which measures the pressure of the pressure fluid acting in the pressure channel 5 and which is arranged in connection with the pressure channel 5 of the percussion device 1. The measurement result obtained is the pressure curve 10 shown schematically in FIG. 2 and representing impact pressure pulsation or pressure pulse of the pressure medium acting in the pressure channel 5. The horizontal axis of FIG. 2 represents time and the vertical axis represents pressure. A measuring signal, which advantageously is a voltage signal, for instance, of the pressure sensor 8, corresponding to the pressure curve 10, is transmitted through a wire 11 to an analyzing device 9, where variables describing the operating state of the percussion device 1 are determined from the measuring signal corresponding to the pressure curve 10. Parameters depicting the operating state of the percussion device 1 or correlating with the operating state of a percussion device include the following parameters, for instance:

- $t_{11}$ an impact moment, i.e. a moment when the percussion piston 3 strikes the drill shank of the rock drill or the tool of the breaking device,
- $t_{12}$ back-timing of the control valve 19 of the percussion device 1, when the reverse movement of the percussion piston 3 starts decelerating,
- $t_{13}$ a back dead centre of the percussion piston 3, when the percussion piston 3 changes its direction of motion,
- $t_{21}$ a next impact,
- $p_1$ the minimum pressure of an impact cycle, i.e. the pressure in the pressure channel 5 at the impact moment,
- $p_2$ an impact pressure value at time instant $t_{12}$,
- $p_3$ the maximum pressure of an impact cycle, i.e. the pressure in the back dead centre.

For instance, the following auxiliary parameters depicting the operating state of the percussion device 1 can be determined from the above parameters:

- $dt_1=t_{12}-t_{11}$ a variable that is in proportion to the reverse velocity of the percussion piston 3 and to the distance the percussion piston has travelled from the impact point. It is possible to use the variable indirectly for determining the impact point, i.e. the position of the percussion piston 3 at the impact moment and also for identifying the rock type.
- $dt_3=t_{21}-t_{13}$ a parameter relating to the impact velocity,
- $t_{tot}=t_{21}-t_{11}$ the time of an impact period, i.e. the inverse of running frequency f,
- $x=(p_2-p_1)/(p_3-p_1)$ a ratio relating to the piston stroke length, which can be used for adjusting the impact point, for instance.

On the basis of the parameters depicting the operating state of the percussion device 1 or the auxiliary parameters determined therefrom it is possible to determine the operating state of the percussion device 1. For instance, the operating state of the percussion device 1 can be depicted by one or more of the following variables: position of the percussion piston 3 in the percussion device 1, piston stroke length of the percussion piston 3, impact velocity, rebound velocity, running frequency of the percussion device 1, or statistical parameters obtainable of the same.

The parameters depicting the operating state of the percussion device 1 or auxiliary parameters determined therefrom and thus the operating state of the percussion device 1 can be used for determining the drilling conditions. The drilling conditions refer to a drilling state, which is affected by the rock to be drilled, drilling equipment used and drilling parameters, such as impact power, feed force, rotating torque and flushing pressure, the measurable variables directly proportional to them being impact pressure, feed pressure, rotating pressure and flushing pressure.

Thanks to the solution the operation of the percussion device 1 can be monitored accurately and in real time. This also enables the control of the operation of the percussion device 1 in real time on the basis of the parameters depicting the operating state of the percussion device 1 and obtained from one or more previous impacts, and thus on the basis of the operating state of the percussion device 1. The pressure curve 10 of the percussion device 1 can be measured in a simple manner. It is not necessary to arrange any fault-prone sensors in the percussion device 1, but the measurement can be carried out in the vicinity of the percussion device, or elsewhere, on a boom or base carrying the percussion device. The pressure curve 10 measurement and interpretation make it possible to monitor the trend of the percussion device state and use it for monitoring the condition of the percussion device 1 and the whole rock drill or percussion hammer, for instance, in situations where the pressure curve 10 changes as pre-charge of the rock drill or the percussion hammer accumulator changes or as the accumulator diaphragm breaks or in situations where the pressure curve 10 changes as the rock drill shank wears.

Figure 3:
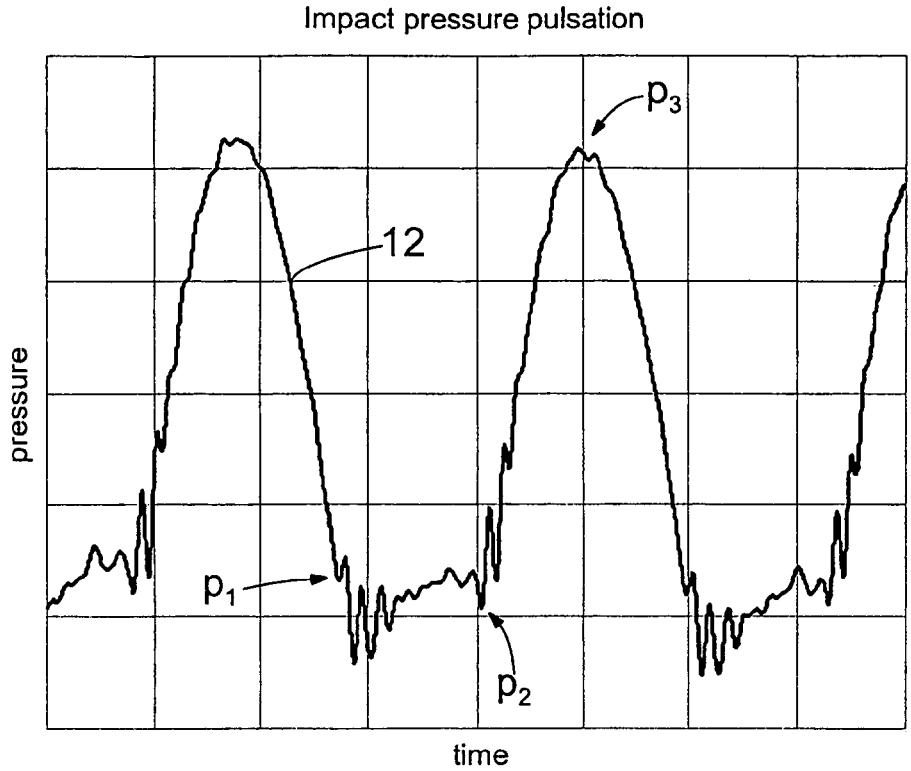
FIG. 3 is a first pressure curve of a percussion device measured on a rock drill machine.
Figure 4:
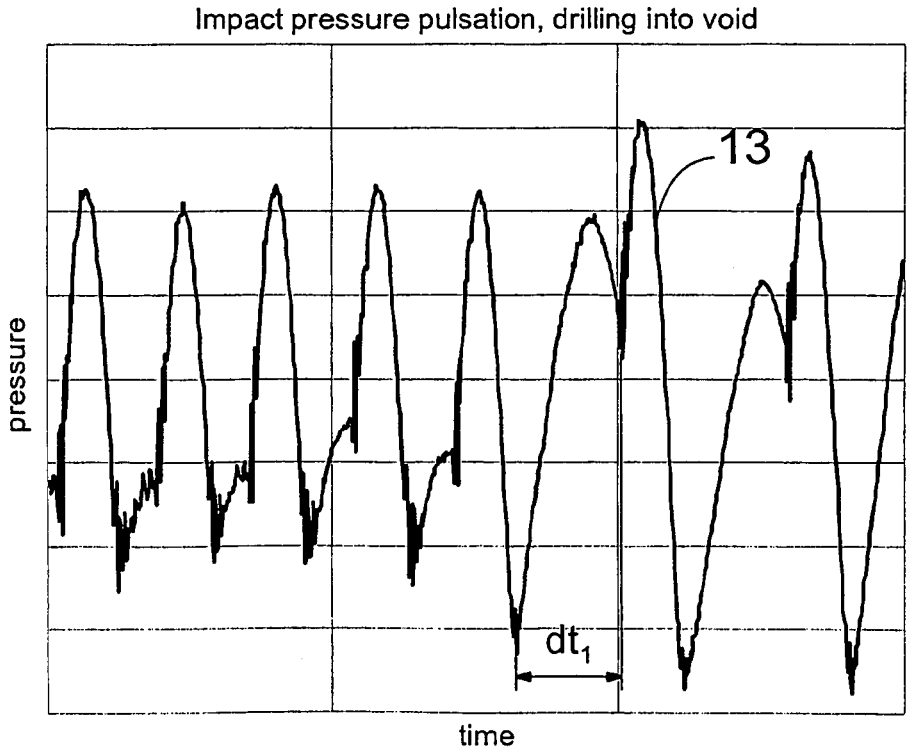
FIG. 4 is a second pressure curve of a percussion device measured on a rock drill machine.
Figure 5:
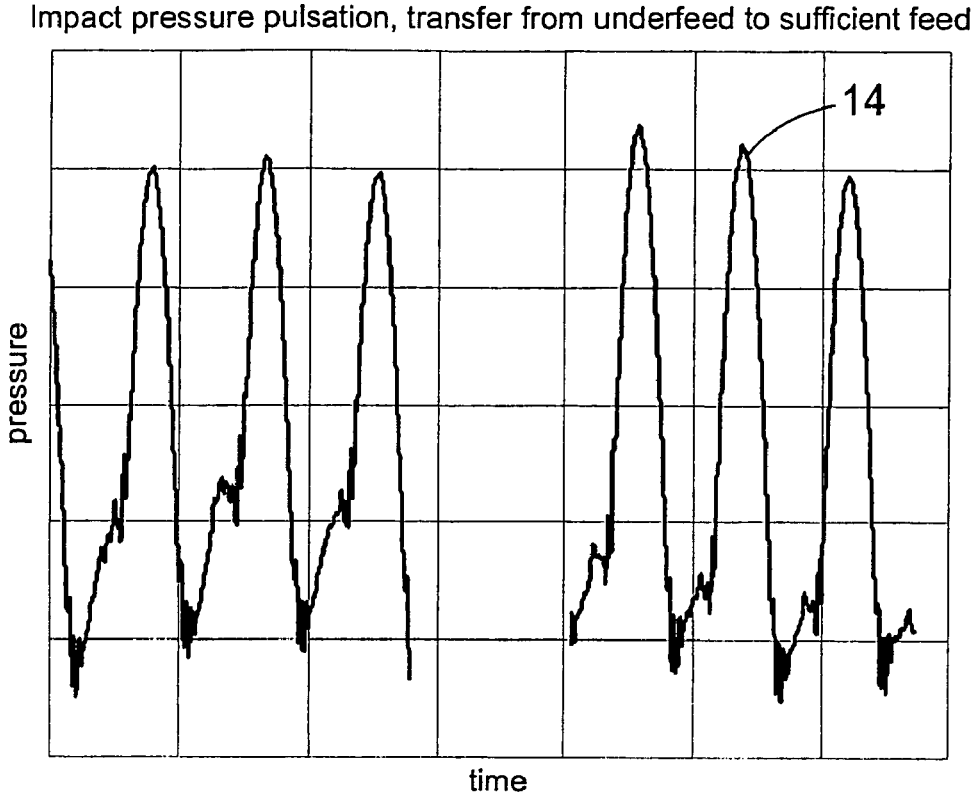
FIG. 5 is a third pressure curve of a percussion device measured on a rock drill machine.

FIG. 3 shows a percussion device pressure curve 12 measured from a rock drill. The pressure curve 12 is measured in a situation where the drilling conditions have remained substantially constant. FIG. 3 also shows a point that corresponds to the minimum pressure of the impact cycle, i.e. pressure $p_1$ in the pressure channel 5 at an impact moment, a point corresponding to an impact pressure value $p_2$ at a time instant $t_{12}$ and a point corresponding to the maximum pressure $p_3$ of the impact cycle, i.e. the pressure at the back dead centre. FIG. 4, in turn, shows a percussion device pressure curve 13 measured from a rock drill, when it hits a void. In the situation of FIG. 4 the parameter $dt_1$ corresponding to linear momentum of the percussion piston and the parameter x corresponding to the piston stroke length have increased, because feed resistance has decreased. When the parameters $dt_1$ and x rise to a sufficiently high level, it indicates that the rock drill has hit a void, as has happened in the case of FIG. 4. FIG. 5 shows yet another percussion device pressure curve 14 measured from a rock drill in a situation, where transfer from underfeed to sufficient feed has taken place by increasing the feed. The underfeed was detected on the basis of the parameter x.

Figure 6:
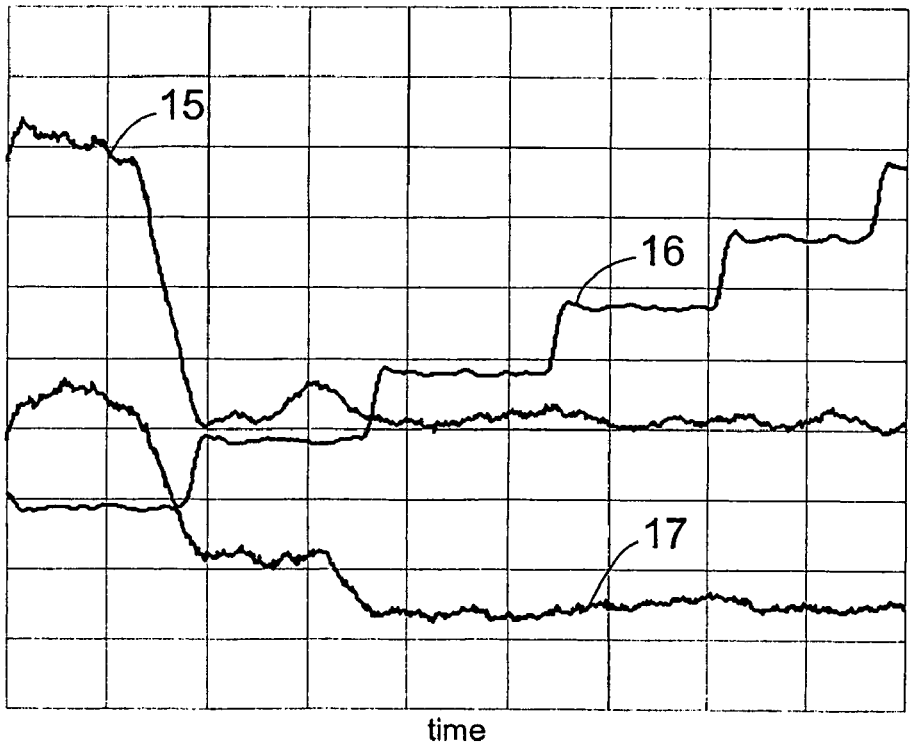
FIG. 6 shows interdependence of the maximum tensile stress of a stress wave reflecting from the rock to be drilled, feed force and a variable representing the quality of feed.

FIG. 6 shows the maximum tensile stress 15 of a stress wave reflected from the rock to be drilled, feed force 16 and a parameter x indicated by curve 17 as measured from a rock drill. On the basis of the parameter x it is possible to determine whether the impact energy is excessive in relation to the feed pressure. When the feed is sufficient, the tensile stresses do not decrease substantially and the value of the parameter x stabilizes. The level of the tensile stress indicates the actual quality of drilling. Because it is very difficult to measure the tensile stress during the drilling, the same objective will be achieved by means the parameter x.

Figure 7:
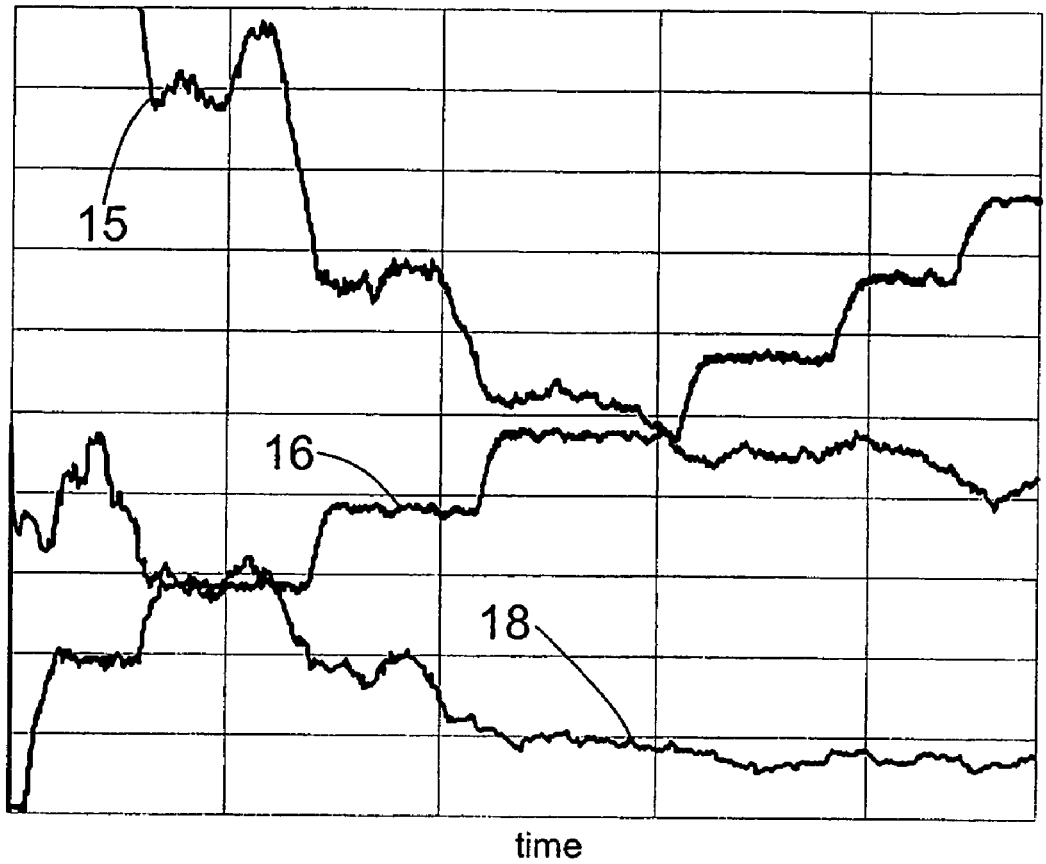
FIG. 7 shows interdependence of the maximum tensile stress of a stress wave reflecting from the rock to be drilled, feed force and a second variable representing the quality of feed.

FIG. 7 shows the maximum tensile stress 15 of a stress wave reflected from the rock to be drilled, feed force 16 and moving standard deviation 18 of the impact frequency determined from the pressure curve of the percussion device pressure fluid as measured from a rock drill. It appears from FIG. 7 that, when the feed force is increased and when it has reached a given value, a drilling situation is achieved which corresponds to sufficient feed and in which the tensile stresses will not substantially decrease. This can also be detected by the fact that the moving standard deviation 18 value of the frequency stabilizes.

FIG. 1 also shows a control unit 20, which is arranged to control the operating state of the percussion device 1 on the basis of the percussion device operating state determined in the analyzing device 9. The operating state of the percussion device 1 is conveyed from the analyzing device 9 to the control unit 20. Instead of being two separate units, the analyzing device 9 and the control unit 20 can be integrated into one device or unit. In FIG. 1, the control unit 20 is arranged to control the operation of the pump 4, for instance, by changing the rotating speed or cycle volume of the pump 4. Instead of or in addition to the pump 4 control, it is also possible to control the operation of the percussion device 1 in a variety of ways, for instance, by controlling the operation of the control valve 19. It is also possible to control the operating state of the percussion device 1, for instance, by controlling the feed force as described in connection with FIGS. 6 and 7.

The drawings and the relating description are only intended to illustrate the inventive idea. The details of the invention may vary within the scope of the claims. Hence, the percussion device 1 can also be operated by compressed air, whereby air, and not pressure liquid, is used as pressure medium, and the pump 4 can be replaced by a compressor and return air can be discharged directly into ambient air. Further, it should be noted that the pressure curve pulsation may vary, for instance, due to various pressure losses as hydraulic tubing is changed.

The invention claimed is:

1. A method for monitoring the operation of a percussion device, which percussion device comprises a percussion piston and a pressure channel for supplying pressure medium to the percussion device for moving the percussion piston, the method comprising measuring pressure pulsation of the pressure medium acting in the pressure channel, which pressure pulsation is depicted as a pressure curve, determining, from pressure pulsation, parameters depicting the operating state of the percussion device and determining the operating state of the percussion device on the basis of said parameters, wherein the operating state of the percussion device is depicted by at least one of the following variables: the position of the percussion piston in the percussion device, the stroke length of the percussion piston, the impact velocity of the percussion piston and the rebound velocity of the percussion piston.

2. A method as claimed in claim 1, comprising determining auxiliary parameters on the basis of the parameters depicting the operating state of the percussion device and determining the operating state of the percussion device on the basis of said parameters and the auxiliary parameters determined therefrom.

3. A method as claimed in claim 1, comprising controlling the operating state of the percussion device on the basis of the operating state or the parameters depicting the operating state of the percussion device.

4. A method as claimed in claim 1, wherein the percussion device is arranged for use in a rock drill machine and the operating state of the rock drill machine is determined on the basis of the parameters depicting the operating state of the percussion device.

5. An apparatus for monitoring the operation of a percussion device, the percussion device comprising a percussion piston and a pressure channel for supplying pressure medium to the percussion device for moving the percussion piston, the apparatus comprising a sensor arranged in connection with the pressure channel for measuring pressure pulsation of the pressure medium acting in the pressure channel and depicting said pressure as a pressure curve and an analyzing device, which is arranged to determine parameters depicting the operating state of the percussion device from the pressure pulsation and to determine the operating state of the percussion device on the basis of said parameters, wherein the operating state of the percussion device is depicted on the basis of at least one of the following variables: the position of the percussion piston in the percussion device, the stroke length of the percussion piston, the impact velocity of the percussion piston and the rebound velocity of the percussion piston.

6. An apparatus as claimed in claim 5, wherein the analyzing device is arranged to determine auxiliary parameters on the basis of the parameters depicting the operating state of the percussion device and further to determine the operating state of the percussion device on the basis of the parameters depicting the operating state of the percussion device and the auxiliary parameters calculated therefrom.

7. An apparatus as claimed in claim 5, wherein the operating state of the percussion device is arranged to be controllable according to the operating state of the percussion device or the parameters depicting the operating state.

8. An apparatus as claimed in claim 5, wherein the percussion device is arranged for use in a rock drill and the operating state of the rock drill machine is arranged to be determined on the basis of the parameters depicting the operating state of the percussion device.

9. An arrangement for controlling the operation of the percussion device, the percussion device comprising a percussion piston and a pressure channel for supplying pressure medium to the percussion device for moving the percussion piston, the arrangement comprising a sensor arranged in connection with the pressure channel for measuring pressure pulsation of the pressure medium acting in the pressure channel and depicting said pressure as a pressure curve, an analyzing device, which is arranged to determine parameters depicting the operating state of the percussion device from the pressure pulsation and to determine the operating state of the percussion device on the basis of said parameters, which operating state of the percussion device is depicted on the basis of at least one of the following variables: the position of the percussion piston in the percussion device, the stroke length of the percussion piston, the impact velocity of the percussion piston and the rebound velocity of the percussion piston and a control unit which is arranged to control the operation of the percussion device on the basis of the operating state of the percussion device.

* * * * *